United States Patent [19]

Dickey

[11] 4,357,490

[45] Nov. 2, 1982

[54] HIGH FIDELITY LOUDSPEAKER SYSTEM FOR AURALLY SIMULATING WIDE FREQUENCY RANGE POINT SOURCE OF SOUND

[76] Inventor: Baron C. Dickey, 982 Yorktown Dr., Sunnyvale, Calif. 94087

[21] Appl. No.: 169,990

[22] Filed: Jul. 18, 1980

[51] Int. Cl.[3] ..... H04R 1/20

[52] U.S. Cl. ..... 179/1 E; 181/145; 181/147; 181/155

[58] Field of Search ..... 179/1 E; 181/144, 145, 181/146, 147, 155

[56] References Cited

U.S. PATENT DOCUMENTS

| | | | |
|---|---|---|---|
| 2,065,367 | 12/1936 | Evans | 181/31 |
| 2,541,946 | 2/1951 | Stark | 181/31 |
| 2,732,907 | 1/1956 | Leon | 181/31 |
| 3,931,867 | 1/1976 | Ianszen | 179/1 E |
| 4,006,308 | 2/1977 | Pönsgen | 179/1 E |

FOREIGN PATENT DOCUMENTS

| | | | |
|---|---|---|---|
| 2052045 | 4/1972 | Fed. Rep. of Germany | 179/1 E |
| 2140926 | 3/1973 | Fed. Rep. of Germany | 179/1 E |
| 2162347 | 6/1973 | Fed. Rep. of Germany | 181/155 |
| 2251178 | 5/1974 | Fed. Rep. of Germany | 179/1 E |
| 2433916 | 1/1976 | Fed. Rep. of Germany | 181/155 |

*Primary Examiner*—George G. Stellar

*Attorney, Agent, or Firm*—C. Michael Zimmerman

[57] ABSTRACT

The loudspeaker system utilizes an ellipsoidal reflector of substantially the same diameter as the low frequency (LF) driver, positioned on-axis of the LF driver, as a reflective dispersing means for increasing the angular dispersion of acoustical energy, especially in the upper range of the LF driver. The ellipsoidal reflector is also utilized as a means to mount the higher frequency (HF) drivers in such a way that their axes diverge generally uniformly away from a point near the center of the ellipsoid so that the sound field of the higher frequency drivers is also well dispersed. The result is that the ellipsoid causes acoustical energy both from the LF driver and the HF drivers to appear to emanate from a point near the center of the ellipsoid, simulating the sound field generated by a single wide frequency range point source of sound.

9 Claims, 2 Drawing Figures

HIGH FIDELITY LOUDSPEAKER SYSTEM FOR AURALLY SIMULATING WIDE FREQUENCY RANGE POINT SOURCE OF SOUND

BACKGROUND OF THE INVENTION

Since the advent of sound recording near the end of the nineteenth century, ways have been sought to make the reproduction of sound, and especially music, approach as closely as possible the sound field created by an original source of sound. Despite occasional announcements that the ultimate of perfection has been reached, in the intervening time up until the present, much experimentation and theorizing has continued with the object in mind of so improving the quality of sound reproduction that the listener is persuaded he is hearing a live performance.

In earlier times, attempts to achieve this ideal centered around a series of efforts to improve the linearity of the various transducers, amplifiers, broadcast and receiving means in the audio chain. Although these improvements were of great benefit in enhancing the quality of reproduced sound, it became apparent that no amount of improvement in the linearity of reproduction by itself could adequately recreate the auditory experience of listening to a live source of music. This was especially true in the reproduction of music produced by such large groups as bands, orchestras and choruses, but was present to a lesser degree also in the sound from solo instrumentalists and vocalists.

Consequently, since approximately the middle 1950's growing emphasis has been placed upon attempts to record and reproduce the phase and aural space relationships of live sound sources. Specifically, it was realized that the abilities of the human ear to spatially locate sound sources based upon cues derived from phase relationships and relative intensity differences between sound heard by the left and right ear was considerable. Consequently, attempts to more adequately account for these sensitivities of human hearing in the design of audio systems brought about a considerable interest in multiple-channel recording and reproduction of sound, in phase relationships among the several drivers in loudspeaker systems, and in the accurate recreation of the reflected or ambient sound field which naturally results from the production of sound in an enclosed space such as a room or hall, due to the considerable reflection of sound from the walls, ceiling and floor.

An accurate portrayal of the reflected sound field is believed to be particularly important not only because reflected sound comprises a significant part of the sound actually heard by a listener at a symphonic concert, for example, but also because reflected sound, travelling as it does a longer path from source to listener and approaching him from a different angle than the original source of sound, considerably alters the harmonic content of perceived sounds and the perceived size and location of the sound source itself.

In order to effectively duplicate the richness and complexity generated by a significant reflected sound field, the loudspeaker must possess to a considerable degree the quality known as dispersion by which is meant the ability to distribute reproduced sound over a very wide angle. In this way, reflected sound from all of the reflective sounding surfaces of a room, for example, can be generated such that the perception of the sound field approximates that of an original source of sound.

Individual electrodynamic drivers in which the diaphragm is a cone or hemisphere are capable of providing near-perfect dispersion only for frequencies low enough such that the reproduced wavelength is large in comparison to the effective piston diameter of the driver. For our purposes, the effective piston diameter may be defined as the diameter of a circular diaphragm which, driven to the same mean excursion, would generate the same sound pressure level (SPL) as the actual driver under consideration. For many cone-diaphragm loudspeakers, effective piston diameter in the frequency range below cone "break-up" may be approximated as 0.9 times nominal loudspeaker diameter. Since the upper frequency limit of audible sound extends at least as high as 15 kHz, where the wavelength is only 2.3 cm., and down to as low as 30 Hz where the wavelength is approximately 11.5 m., it becomes obvious that maintaining equally broad dispersion at all frequencies in the audible spectrum is a difficult task!

An ideal radiator for achieving this goal might be conceived in the form of a point source of sound covering equally well the entire audible range of 20–20,000 Hz. However, a few simple calculations reveal the impracticality of ever actualizing such a source in practice. The volume of air required to be moved, or "pumped", in order to produce a peak sound pressure level of 110–120 db (SPL) such as would be required to adequately reproduce sharp attacks during fortissimo passages of orchestral music would require that the theoretical point source of sound be replaced by a pulsating sphere of considerable dimensions.

In fact such a sphere can, using existing technology, only be approximated by mounting a plurality of discrete drivers spaced over the surface of a spherical enclosure. Such reproducers have been built from time to time (see for example U.S. Pat. No. 4,006,308 to Pönsgen which utilizes a hemispherical enclosure).

Unfortunately, when this approach is extended to a full sphere, and when reasonable driver efficiency levels are considered and reasonable sound pressure levels such as 110 db are contemplated at frequencies below 50 Hz, the required spherical enclosure will be uncomfortably large and the number of drivers which must be spaced over its surface in order to provide adequate dispersion at all frequencies becomes so large that the approach cannot be considered practicable either from the standpoint of aesthetics or economics.

For example, it has been calculated that a practical design capable of producing a sound pressure level of 110 db at 20 Hz and having efficiency of approximately 90 db (SPL) at one meter for a one watt input would require a spherical enclosure having an internal volume of approximately seven cubic feet, or a diameter of nearly three feet! Since such a spherical loudspeaker would have extremely limited acceptance in the high fidelity marketplace, some way was needed to reduce its size while retaining its abilities to simulate the sonic characteristics of a wide frequency range point source of sound.

As is obvious to those skilled in the art, the requirement for such a large sphere results virtually entirely from the requirement for large products of diaphragm movement and diaphragm area in order to generate high amplitudes of sound at low bass frequencies.

Consequently, the principal line of approach to reduction in the size of the sphere might begin with a division of the loudspeaker system into a lower frequency reproducer located outside the sphere with the higher frequency reproducers remaining on the surface of the sphere, now much reduced in size.

While such division of the frequency spectrum into two parts is entirely routine, requiring only the use of either active or passive filter networks, it was realized that if the system were to function as an accurate simulator of a wide frequency range point source of sound, provision had to be made to cause at least the upper portion of the frequency range from the lower frequency reproducer to appear to emanate from the sphere in coincidence with the sound from the higher frequency reproducers located on the sphere surface.

Since the human ear has little ability to localize the source of extremely low frequency acoustic energy (say, below 90 Hz or thereabouts), no particular provision need be made for enhancing the already excellent dispersion of this band of frequencies. However, if the lower frequency reproducer is to be called upon to extend much above the frequency range of the lowest bass notes, it is important to make its output in this range appear to emanate from the center of the sphere. Moreover, it is important that the dispersion of the upper portion of the frequency range of the lower frequency reproducer be smooth and uniform, especially in the horizontal plane. Finally, it is important that the path length from the low frequency reproducer to listeners in the far field of the loudspeaker be sufficiently identical to the path length from the higher frequency reproducers such that phase coherency problems are minimized or at least small enough to be easily corrected.

SUMMARY OF THE INVENTION

The principal object of the present invention is to provide a high fidelity loudspeaker which simulates the sound field of a wide frequency range point source of sound.

A second object of the present invention is to provide such a high fidelity loudspeaker in a form which is economically and aesthetically acceptable in the marketplace for audio equipment.

A third object of the present invention is to provide a high fidelity loudspeaker in which a reflective dispersing means for reflectively dispersing the sound from a lower frequency reproducer also has mounted on its surface higher frequency reproducers.

A fourth object of the present invention is to provide a lower frequency reproducer in the form of a direct radiator having an ellipsoidal reflective dispersing means mounted directly on its axis to disperse the direct radiations from said reproducer.

A fifth object of the present invention is to provide a direct radiator lower frequency reproducer having an ellipsoidal dispersing element mounted on its axis and spaced away from the lower frequency driver by an amount selected to enhance the coupling of low frequency radiation to the room.

To the above ends the high fidelity loudspeaker system of the present invention employs an ellipsoidal member both as a mounting means for higher frequency reproducers which are mounted in a spaced array over the surface thereof, and as a reflective, dispersive means for the remaining portion of the audible spectrum from a lower frequency reproducer which is positioned adjacent to and facing the reflective dispersive ellipsoidal member. In this way the low frequency radiations are reflected from the surface of the ellipsoid in a pattern which approximately duplicates that produced by the higher frequency reproducers mounted on the surface thereof, especially as to uniform dispersion in the horizontal plane.

Since the reflective dispersive ellipsoidal member is positioned closely adjacent to the radiating region of the lower frequency reproducer and directly inline with the low frequency radiations therefrom, substantially all of these radiations are successfully redirected into a pattern which resembles that produced by the higher frequency reproducers spacedly mounted over the surface of the ellipsoidal member. Consequently, the loudspeaker system is successfully able to simulate the sound field which would be generated by a wide frequency range point source of sound, without resorting to the use of an ellipsoid having a volume of several cubic feet, as would be necessary if the lower frequency reproducer were mounted on the surface of the ellipsoid and used it as an enclosure.

The above and other features, objects and advantages of the present invention, together with the best mode contemplated by the inventor thereof for carrying out his invention will become more apparent from reading the following detailed description of a preferred embodiment, and persuing the drawings in which:

DETAILED DESCRIPTION OF A PREFERRED EMBODIMENT

Figure 1:
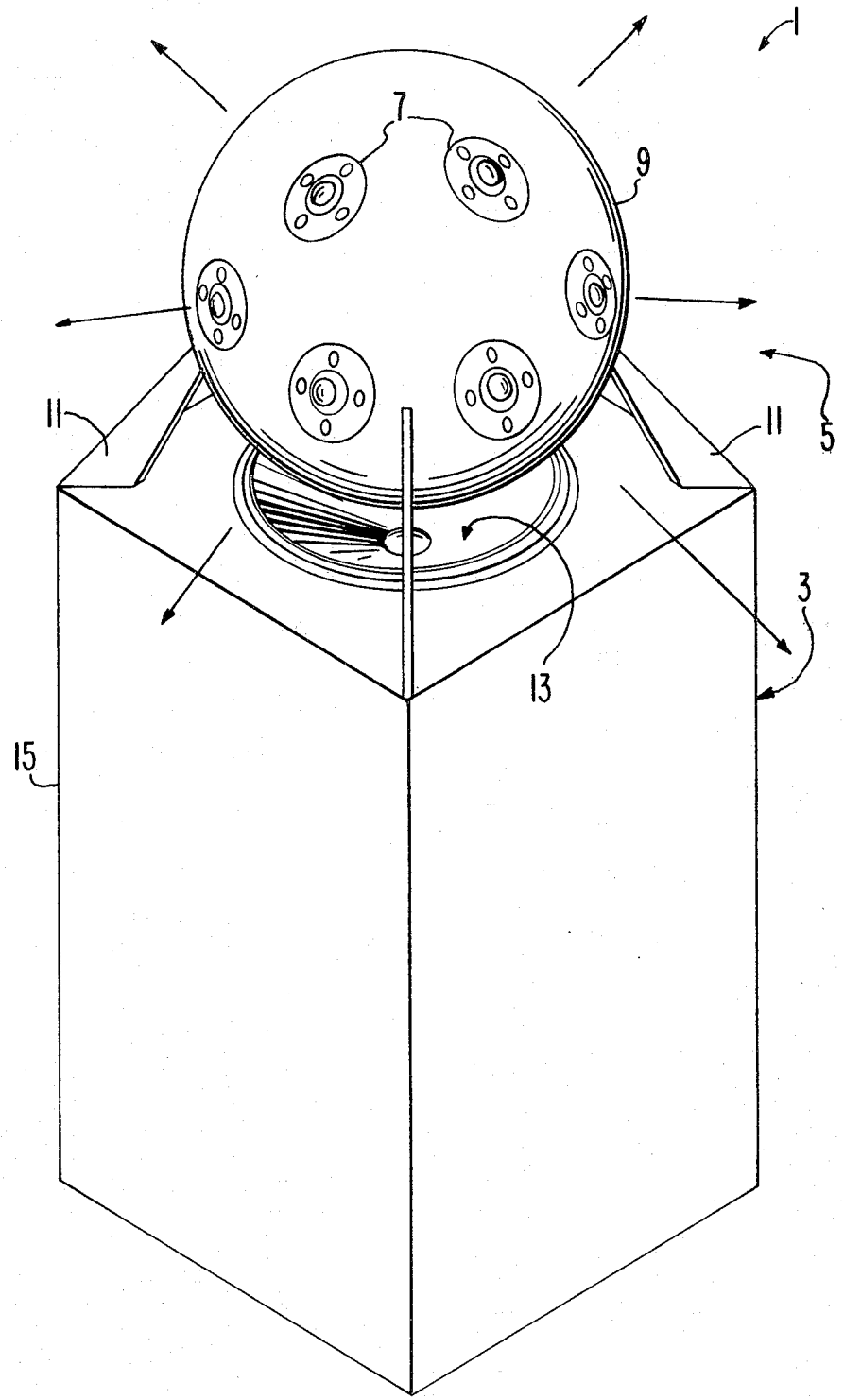
FIG. 1 is an isometric perspective view of a high fidelity loudspeaker system according to the present invention.

In FIG. 1, the loudspeaker system 1 of the present invention is shown to comprise a lower frequency reproducer 3 and a higher frequency reproducer 5. Higher frequency reproducer 5 as shown comprises a plurality of dome radiators, a type of high frequency loudspeaker which is by now familiar for reproduction of the treble range. However, it is to be understood that dome radiators 7 are merely representative of one variety of higher frequency reproducers which may be used in the present invention. Depending upon factors of economics and especially upon the portion of the audible spectrum which is to be reproduced by higher frequency reproducer 5, any known type of middle frequency (MF) or high frequency (HF) reproducer including but not limited to cone- or dome-diaphragm electromagnetic radiators, piezo-electric reproducers, curved or planar electrostatic reproducers, or ionization-plasma reproducers might be used. In general, any known types of middle and upper range reproducers necessary to successfully reproduce the range of frequencies not assigned to lower frequency reproducer 3 could be used.

Dome radiators 7 are mounted spaced over the surface of a convex reflective disperser 9, which in the drawing is shown as a spheroid but which might be any other variety of ellipsoid in practice. Preferably, dome radiators 7 should be spatially oriented with respect to one another such that their axes diverge uniformly away from a point near the center of the ellipsoid, as stated in the Abstract of this disclosure. In practice, such orientation can be achieved simply by mounting these elements flush with, and equispaced over the surface of, the ellipsoid. The number of dome radiators 7 required to be so spacedly mounted over the surface of disperser 9 will in practice be determined by a consideration of the polar radiation pattern of dome radiators 7, especially at the upper portion of the audible range where the effects of "beaming", i.e., inadequately wide dispersion, are most prominent, and in view of the desire to create by such mounting of a plurality of radiators 7, a highly uniform pattern of dispersion of the sound from higher frequency reproducer 5.

Convex reflective disperser 9 may be made of any suitably rigid material and may be hollow or solid. In the event that disperser 9 is made hollow, it will be important to provide that the walls thereof are sufficiently rigid or internally braced or adequately damped with a resilient internal filling, for example, such that significant resonances in any part of the audible range are not excited, disperser 9 being an essentially passive element in the system. In the event that disperser 9 is made solid, then suitable apertures may be bored therein for the mounting of dome radiators 7. Of course, if disperser 9 is to serve as an enclosure for loudspeakers covering a frequency range extending below the normal mid-frequency range, say from 250 Hz upwardly to the uppermost treble range, then the above mentioned damped, hollow construction may be desirable as a means of providing sufficient enclosure volume.

Disperser 9 may be mounted by means of a plurality of struts 11 upon one face of lower frequency reproducer 3 as shown in the drawing. Alternatively, other constructions such as an overhead single-point suspension of disperser 9 over lower frequency reproducer 3 may be employed.

Figure 2:
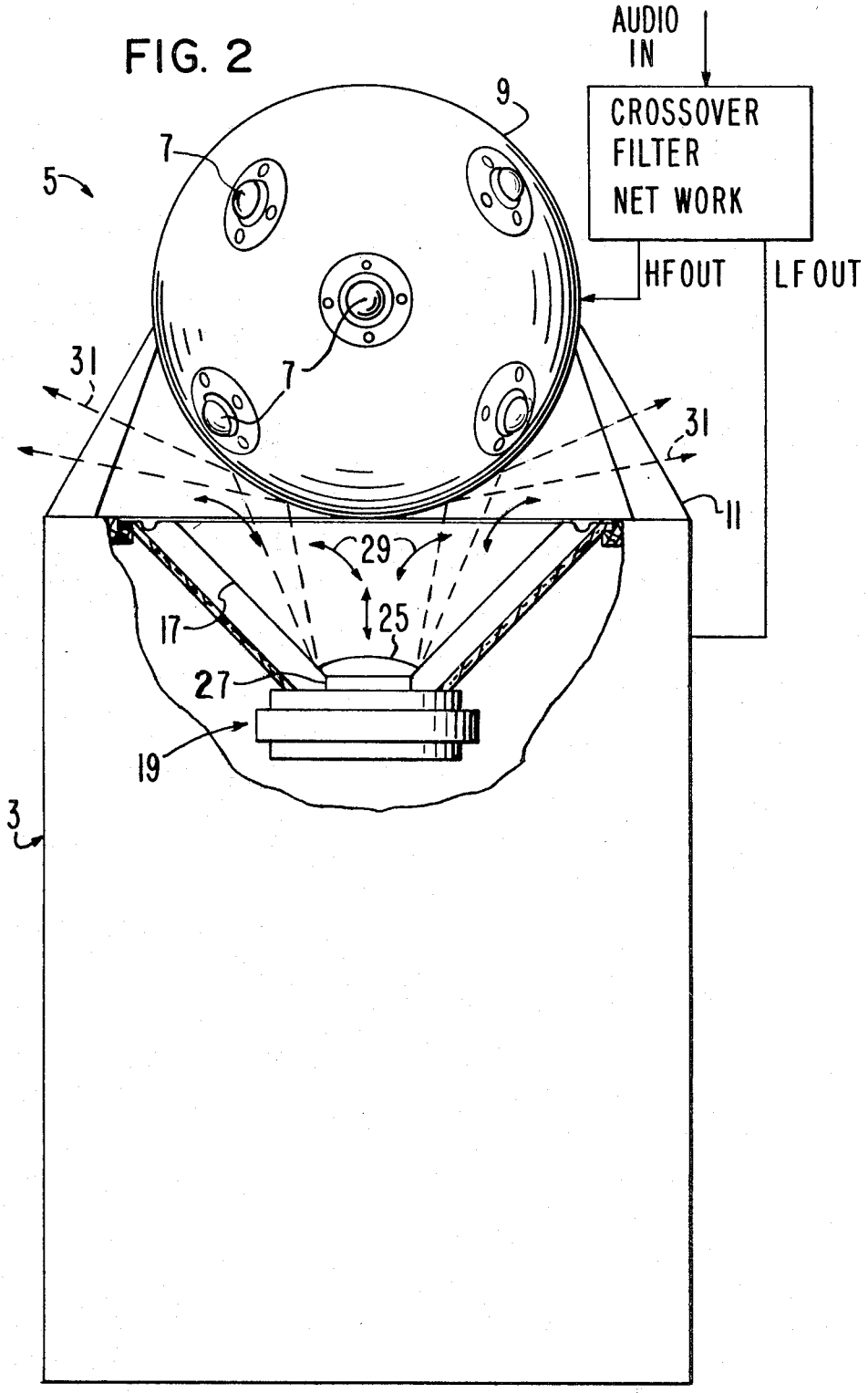
FIG. 2 is a partially cut-away view of the structure of FIG. 1 showing the details of the lower frequency reproducer according to the present invention.

As shown especially in FIG. 2, lower frequency reproducer 3 consists fundamentally of a low frequency loudspeaker 13, commonly called a "woofer", and a low frequency enclosure 15. Low frequency loudspeaker 13 is received and mounted within an aperture in the surface of enclosure 15. Low frequency enclosure 15 may comprise any of the well-known types of low frequency enclosures such as the totally enclosed box, transmission line system, or bass reflex system.

As best seen in FIG. 2 of the drawing, low frequency loudspeaker 13 may be of a conventional construction employing basically a cone diaphragm 17 driven by a voice coil (not shown) immersed in a powerful magnetic field generated by a magnet structure 19. A loudspeaker frame 21 made for example of stamped sheet steel or of various cast alloys serves fundamentally as a means for securely mounting low frequency loudspeaker 13 within a correspondingly shaped and dimensioned aperture in the upper surface of enclosure 15 and for rigidly positioning magnet structure 19 in relation to cone diaphragm 17. In conventional fashion, cone diaphragm 17 may be mounted at its outer periphery by a half-roll surround 23, and near its apex adjacent magnet structure 19 by a conventional corrugated suspension made of resin-impregnated fabric or any other suitable means for positioning the voice coil (not shown) in the magnetic gap of magnet structure 19. A dome cap 25 is positioned over the aperture formed at the apex of cone diaphram 17 by the joinder thereto of a hollow cylindrical voice coil former 27.

The cooperation between low frequency loudspeaker 13 and convex reflective disperser 9 positioned immediately adjacent and on-axis of loudspeaker 13 in order that the two together may successfully reproduce the lower frequency spectrum of sound with a high degree of dispersion which will match that produced by higher frequency reproducer 5 is best understood by considering the cross-sectional view of FIG. 2 in which the region of space between cone diaphragm 17 and disperser 9 is clearly illustrated.

The interaction of disperser 9 with low frequency radiations coming from lower frequency reproducer 3 is somewhat complex and varies according to the portion of the frequency spectrum of lower frequency reproducer 3 under consideration. For example, at the very lowest bass frequencies from perhaps 90 Hz downwardly, the wavelength of acoustic vibrations is in general very large in comparison to the dimensions of the reproducers involved. At 90 Hz the wavelength of sound is more than 12 feet, whereas for a nominal diameter of 15 inches for low frequency loudspeaker 13, the actual effective piston diameter of cone diaphram 17 is typically on the order of 13–14 inches, little more than one foot. Consequently, in the lowest region of bass frequencies, the polar radiation pattern of lower frequency reproducer 3 is essentially omnidirectional such that adequate dispersion of these frequencies is obtained even without disperser 9 interposed directly in the axial path of the radiations.

Nevertheless, even in this lowest frequency region disperser 9 positioned generally as shown on-axis of low frequency loudspeaker 13 has been found to offer significant benefits in enhancing the reproduction of sound. It is believed that the explanation for this phenomenon is that a significant improvement in coupling, or radiation efficiency, between the region of space surrounding loudspeaker system 1 and cone diaphragm 17 is achieved. In particular, the solid arrows 29 in FIG. 2 illustrate the mode of propagation of the lowest frequency portion of the audio spectrum from cone diaphragm 17. It is to be noted that the interposition of disperser 9 on-axis of low frequency loudspeaker 13 significantly limits the solid angle of free space into which cone diaphragm 17 must successfully couple acoustic vibrations. In the absence of disperser 9, this solid angle would be equivalent to one-half sphere of free space ($2\pi$ steradians). Instead, cone diaphragm 17 need only radiate into the annular region between the periphery of cone diaphragm 17 and the adjacent portion of disperser 9.

Since this region may be made as small or as large as desired by proper selection of the dimensions of disperser 9 relative to the diameter of cone diaphragm 17 and by also selecting an optimum distance separating disperser 9 and diaphragm 17, the size of the gap separating these two elements may be varied at will. In practice I have found empirically that when a spherical form of disperser 9 is employed, optimum functioning with respect to low frequency reproduction is achieved by dimensioning the diameter of the sphere to be within the range of 0.5–1.5 times the effective piston diameter of cone diaphragm 17, with the absolute optimum occuring when the sphere has approximately the same diameter as cone diaphragm 17. Similarly I have found that using a conventional low frequency diaphragm-type loudspeaker employing a cone diaphragm, that the distance separating a spherical form of disperser 9 and the cone diaphragm 17 is optimum when the region of closest approach (near the edge of cone diaphragm 17) is approximately 0.2 times the effective piston diameter of diaphragm 17. However, it is believed that the cone angle of cone diaphragm 17 and possibly other factors may influence this dimension in a relatively minor way.

Also shown in FIG. 2 are a pair of dotted arrows 31 which are representative of the path of acoustic radiation from cone diaphragm 17 in the upper portion of the low frequency region, say in the region above 200 Hz. As shown, these arrows follow paths of reflection in which after impinging on the lower surface of disperser 9, they are redirected by the curved reflective surface of disperser 9 into a uniformly dispersed pattern. Of course it will be understood that depending upon the portion of the low frequency audio spectrum which is to be reproduced by lower frequency reproducer 3 the reflective region of dotted arrows 31 need not be encountered. For example, if a 100 Hz cross-over frequency were employed substantially the entire portion of the spectrum being reproduced by lower frequency reproducer 3 would be propagated in accordance with the paths illustrated by solid arrows 29.

However, such a low cross-over frequency requires that most of the spectrum be reproduced by higher frequency reproducer 5. Such a choice would naturally require that a number of fairly sizable loudspeakers be mounted on reflective disperser 9 in order to adequately cover the range from 100 Hz to 20 KHz with adequate dispersion throughout the audible spectrum. The result of such a choice would be that disperser 9 would grow uncomfortably large and would probably be unacceptable from a number of viewpoints including aesthetics and economics. Consequently, a cross-over frequency in the range above 250 Hz will be found more practical. Moreover, with the use of the refective disperser 9 according to the present invention, it is possible to successfully use a cross-over frequency high enough that the polar radiation pattern of low frequency loudspeaker 13 would otherwise indicate inadequate dispersion as a result of "beaming". This is true of course because of the ability of disperser 9 to redirect significant portions of the beamed acoustic radiation from loudspeaker 13 away from the axis thereof and into a smooth and uniformly radiated dispersion pattern in the horizontal and vertical directions.

Although the invention has been described with some particularity in reference to a single embodiment which comprises the best mode contemplated by the inventor for carrying out his invention, it will be realized by those skilled in the art that many modifications could be made and many apparently different embodiments thus derived without departing from the scope of the invention. Consequently, the scope of the invention is to be determined only from the following claims.

I claim:

1. A high accuracy loudspeaker system for transducing an electrical signal containing frequencies located within a spectrum extending generally over the full range of audible frequencies into a sound field which closely approximates the sound field generated by a wide-frequency-range point source of sound, comprising:

lower frequency reproducer means for reproducing and propagating a certain lower frequency region of said spectrum generally along a first axis;

an ellipsoidal convex reflective dispersing means located on said axis spaced from said lower frequency reproducer means in the direction of sound propagation therefrom, to reflect and disperse acoustical energy from said lower frequency reproducer generally uniformly over a wide angle;

a plurality of discrete higher frequency reproducer means for reproducing and propagating a certain higher frequency region of said spectrum, said higher frequency reproducers being mounted substantially equispaced over the surface of said ellipsoidal dispersing means and being so spatially oriented with respect to one another as to cause their axes of propagation to diverge generally uniformly away from a point near the center of said ellipsoidal dispersing means;

means to permit commonly energizing each of said plurality of higher frequency reproducer means with a single higher frequency signal, and to permit energizing said lower frequency reproducer means with a lower frequency signal.

2. The loudspeaker system of claim 1 wherein said ellipsoidal dispersing means is a spheroid.

3. The loudspeaker of claim 1 wherein said lower frequency reproducer comprises a low frequency loudspeaker and a hollow enclosure for said loudspeaker, said enclosure having an aperture in one wall thereof within which said loudspeaker is mounted, said convex reflective dispersing means being positioned adjacent to, but spaced from, said loudspeaker to receive said low frequency acoustical energy by direct radiation therefrom.

4. The loudspeaker system of claim 1 wherein said means to permit energizing said reproducers comprises crossover filter means connected in circuit with said lower frequency reproducer and with each of said higher frequency reproducers to attenuate the output of said lower frequency reproducer above a selected crossover frequency and to attenuate the output of said higher frequency reproducers below said crossover frequency.

5. The loudspeaker system of claim 1 wherein said reflective dispersing means is positioned adjacent said low frequency reproducer to define an open annular region therebetween through which said lower frequencies propagate.

6. The loudspeaker system of claim 5 wherein said lower frequency reproducer comprises a low frequency diaphragm-type loudspeaker and wherein said annular region has a width at the region of closest approach between said loudspeaker diaphragm and said dispersing means of generally 0.2 times the effective piston diameter of said loudspeaker.

7. The loudspeaker system of claim 1 wherein said lower frequency reproducer comprises a low frequency enclosure having an aperture in an upwardly facing wall thereof, and a low frequency loudspeaker mounted within said aperture to radiate upwardly, said reflective dispersing means being positioned above said low frequency loudspeaker in the path of low frequency radiation therefrom.

8. The loudspeaker system of claim 7 wherein said reflective dispersing means comprises a spheroid having a mean diameter in the range of 0.5 to 1.5 times the effective piston diameter of said low frequency loudspeaker.

9. The loudspeaker system of claim 8 wherein said spheroid is a sphere having a diameter generally equal to the effective piston diameter of said low frequency loudspeaker.

* * * * *